United States Patent [19]

Dalin et al.

[11] Patent Number: 4,938,838

[45] Date of Patent: Jul. 3, 1990

[54] METHOD OF REDUCING THE EMISSION OF $NO_x$ GAS FROM A LIQUID CONTAINING NITRIC ACID

[75] Inventors: Ivan Dalin, Surte; Pia Andreasson, Lilla Edet, both of Sweden

[73] Assignee: Eka Nobel AB, Surte, Sweden

[21] Appl. No.: 94,808

[22] Filed: Sep. 10, 1987

[51] Int. Cl.[5] ..... C23F 1/00; C23F 3/06

[52] U.S. Cl. ..... 156/627; 156/642; 156/664; 156/666; 423/390

[58] Field of Search ..... 423/390, 400, 405; 156/664, 642, 666, 627

[56] References Cited

U.S. PATENT DOCUMENTS

| | | | |
|---|---|---|---|
| 2,981,617 | 4/1961 | Hager et al. | 423/390 |
| 3,019,081 | 1/1962 | Doss et al. | 423/390 |
| 3,063,945 | 11/1962 | Blackwell | 423/390 |
| 3,113,836 | 12/1963 | Blackwell | 423/390 |

FOREIGN PATENT DOCUMENTS

| | | |
|---|---|---|
| 50-140333 | 3/1974 | Japan . |
| 50-98439 | 9/1974 | Japan . |
| 54-11027 | 1/1979 | Japan . |
| 57-82480 | 5/1982 | Japan . |
| 2000196 | 6/1979 | United Kingdom . |
| 2027004 | 2/1980 | United Kingdom . |

OTHER PUBLICATIONS

"Control of $NO_x$ in Steel Pickling" (Environmental Progress).

*Primary Examiner*—John Doll
*Assistant Examiner*—Wayne A. Langel
*Attorney, Agent, or Firm*—Burns, Doane, Swecker & Mathis

[57] ABSTRACT

A method of reducing, by the addition of hydrogen peroxide, the emission of $NO_x$ gas in the treatment of a nitric acid-containing liquid is disclosed. In the method the redox potential of the liquid is measured and the amount of added hydrogen peroxide is adjusted in relation to the redox potential.

8 Claims, 1 Drawing Sheet

Figure 1:
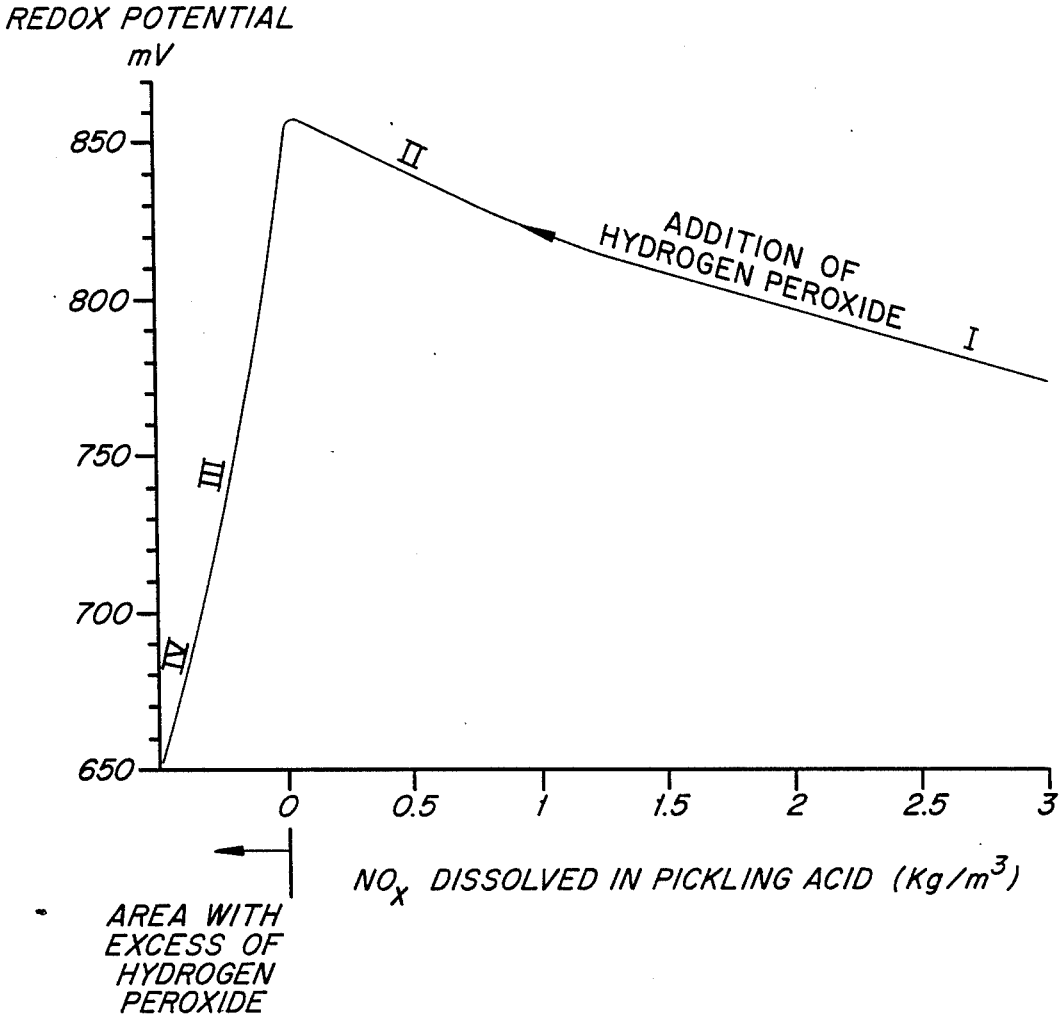

METHOD OF REDUCING THE EMISSION OF $NO_x$ GAS FROM A LIQUID CONTAINING NITRIC ACID

The present invention relates to a method of reducing, by the addition of hydrogen peroxide, the emission of $NO_x$ gas in the treatment of metal in a liquid containing nitric acid.

In many industrial processes, so-called nitrous fumes ($NO_x$) are formed. It is desirable in such processes to limit the amount of gases emitted into the atmosphere, partly because these gases are dangerous to the environment, partly because substantial savings can be made if the emitted gases can be recovered and reused in the process.

In order to reduce the amount of gas emission into the working environment, use has long been made of ventilation devices, however of poor efficiency, which means that large plants are necessary for reducing the gas content to a sufficiently low level in regard of the working environment. These ventilation devices often give rise to external environmental problems. The ventilating air must be purified, which is usually effected in purification plants in the form of tower washers, so-called scrubbers. The efficiency of these scrubbers is low.

The problems associated with large emissions of gas are particularly manifest in processes for pickling stainless steel in nitric acid or in so-called mixed acid, i.e. a mixture of nitric acid and hydrofluoric acid, and in processes for surface treatment of copper and brass etc., in nitric acid or mixtures containing nitric acid.

When nitric acid reacts with metal in such processes, it is reduced to nitrous acid ($HNO_2$) which in turn is in equilibrium with different nitrogen oxides. Primarily, the nitrogen oxides are in the form of NO and $NO_2$. As an example are given the reactions taking place in the treatment of iron in a mixture of nitric acid and hydrofluoric acid:

$$4Fe + 10HNO_3 + 8HF \rightarrow 4FeF_2^+ + 4NO_3^- + 6HNO_2 + 6H_2O \quad [1]$$

$$2HNO_2 \rightleftharpoons N_2O_3 + H_2O \quad [2]$$

$$N_2O_3 \rightleftharpoons NO + NO_2 \quad [3]$$

In the present context, $HNO_2$ and the nitrogen oxides are termed "dissolved $NO_x$", if dissolved in the pickling bath, and "$NO_x$ gas", if in gaseous form.

The emission of $NO_x$ gas from a nitric acid-containing liquid can be reduced by the addition of hydrogen peroxide to the liquid. As a result, dissolved $NO_x$ is reoxidised to nitric acid according to the formula:

$$HNO_2 + H_2O_2 \rightarrow HNO_3 + H_2O \quad [4]$$

The addition of hydrogen peroxide to a pickling bath or a surface treatment bath in order to reduce the emission of $NO_x$ is previously known. DE-A-2532773 (Dart Industries) discloses a method in which a nitrogen peroxide excess of at least 1 g/l is maintained for eliminating the emission of $NO_x$ from a nitric acid bath. JP patent specification 58110682 (Kawasaki Steel Corp.) discloses $NO_x$ reduction with hydrogen peroxide in the pickling of steel in a mixture of nitric acid and hydrofluoric acid.

Environmental Progress, vol. 3, No. 1, 1984, pp. 40–43, discloses $NO_x$ reduction by adding hydrogen peroxide to pickling bath for pickling stainless wire and continuous stainless plates in mixed acid, i.e. nitric acid and hydrofluoric acid. It is suggested that the addition of hydrogen peroxide is controlled by means of a signal measuring the chemiluminescence in the exhaust system from the pickling bath. Further, a pump for the supply of hydrogen peroxide solution is started when the $NO_x$ concentration in the duct system for the exhaust gas exceeds a preset value. However, no experimental results are reported. A system of this type suffers from substantial shortcomings: for instance, chemiluminescent instruments are expensive and difficult to use continuously in the gas concerned which is wet and corrosive. Moreover, some plants have no separate gas ducts from each pickling tank, but these tanks are provided with a common exhaust system. In such cases, it is not possible to adjust the addition of hydrogen peroxide for each separate pickling tank to the concentration of $NO_x$ in the associated exhaust duct.

The variations in time for the formation of dissolved $NO_x$ are most often considerable in pickling plants for stainless steel. In some plants, pickling of metal of varying quality is performed In both cases, the variations in time for the formation of dissolved $NO_x$ may prove substantial. This, in turn, means that the need of hydrogen peroxide varies in time. The chemical environment, such as high temperature, presence of high contents of metals catalyzing decomposition etc., in nitric acid-containing liquids is such that the hydrogen peroxide tends at times to decompose if present in an excessive content, i.e. if the addition at a certain point of time is higher than what is required for converting dissolved $NO_x$ to nitric acid.

Since hydrogen peroxide is an expensive chemical, it is desirable to be able to control the addition of hydrogen peroxide such that, at any point of time, it is on a level which is adjusted to the variation in time for the formation of $NO_x$ and the tendency of the hydrogen peroxide excess to decompose.

By the present invention, there is provided a method of reducing, by the addition of hydrogen peroxide, the emission of $NO_x$ gas in a liquid containing nitric acid, as described in the claims.

The emission of $NO_x$ gas from a nitric acid-containing liquid at a certain temperature and air ventilation is related to the content of dissolved $NO_x$ in the liquid. By controlling the content of dissolved $NO_x$ in the liquid, it is thus possible to control the emission of $NO_x$ gas.

It has been found that the redox potential in a nitric acid-containing liquid is a function both of the content of dissolved $NO_x$ in the liquid and of the hydrogen peroxide excess in the case where all dissolved $NO_x$ has been eliminated. When all dissolved $NO_x$ has been eliminated there is a remarkable and significant drop in the redox potential.

The appearance of the maximum in the redox potential curve can be used for controlling the $NO_x$ content in the nitric acid-containing liquid and, hence, the emission of $NO_x$ gas from the bath.

Figure 2:
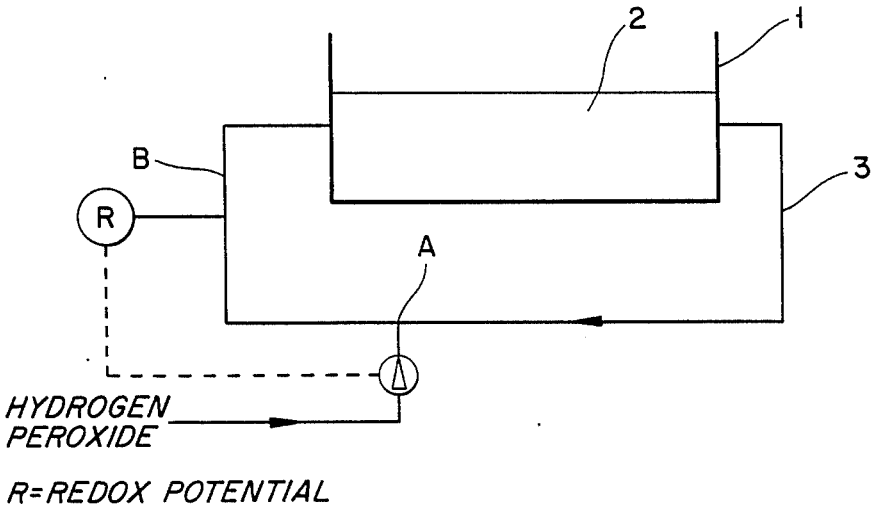

The invention will now be described in greater detail with reference to the accompanying drawings, in which:

FIG. 1 shows the redox potential curve for a pickling bath for stainless steel, and FIG. 2 is a schematic control system for carrying out the method of the invention.

According to the invention it has been found that nitric acid solution containing dissolved $NO_x$ gives a very surprising and useful redox potential curve when titrated with hydrogen peroxide. This curve is illustrated in FIG. 1.

Although the invention in the following is described with reference to reducing $NO_x$ gases from a pickling bath for stainless steel, it is within the scope of the invention that other nitric acid solutions containing $NO_x$ can be treated according to the process. As an example for other uses can be mentioned cases when aqueous nitric acid solutions are used as absorbent solutions for $NO_x$ gases which are dissolved and oxidized to nitric acid by addition of hydrogen peroxide into the absorbent solution, such as absorption/oxidation of $NO_x$ gases from burning of coal, oil or other fuels and from plants for nitration or oxidation of organic compounds with nitric acid.

The addition of hydrogen peroxide is accompanied by a gradual increase in the redox potential, (moving from region I to region II in FIG. 1). At the equivalence point, i.e. when all of the dissolved $NO_x$ is eliminated a maximum redox potential is reached. Addition of a small excess of hydrogen peroxide gives a rapid decrease in the redox potential (regions III and IV in FIG. 1 are reached).

The absolute level of the maximum of the redox potential curve is somewhat dependent on the acid concentration (hydrogen ion concentration) of the system, but the characteristic shape of the curve does not change significantly with variations in acid strength.

As will be described, the unusual shape of the redox potential curve can be used for controlling the $NO_x$ content of the nitric acid. This in turn gives a control of the $NO_x$ gas emission, since the $NO_x$ gas emission is directly related to the content of dissolved $NO_x$ in the acid.

FIG. 2 shows a schematic control system for carrying out the method of the invention. The system consists of a tank for pickling stainless steel in a pickling bath 2 containing nitric acid. The tank is provided with a circulation conduit 3 for circulating the liquid. In the circulation conduit, there is a dosage point A for supplying hydrogen peroxide and a measuring point B for measuring the redox potential in the bath. The dosage point A for hydrogen peroxide is located upstream of the redox potential measuring point B.

When the plant is in operation, the liquid is pumped through the circulation conduit at such a flow rate that the content of dissolved $NO_x$ (because of new formation of $NO_x$ in the pickling process) will not increase by more than 10–20% of the saturation value during passage of the liquid through the pickling bath. In this manner, it is possible to obtain an 80–90% reduction of the emission of $NO_x$ In plants presently used, this corresponds to a circulation time of 0.1–2 h, preferably 0.2–1 h.

A regulator R is connected to the redox potential meter for controlling the supply of hydrogen peroxide, such that a constant redox potential value (equalling the set point of the regulator) is obtained at point B. Regulators of conventional types, such as a so-called PID regulator, can be used.

At the start of the operation the redox potential maximum value is first determined. This can be done by gradually increasing the hydrogen peroxide flow into the circulating flow of acid containing dissolved $NO_x$, and record the highest potential that is reached before the potential is again decreasing.

This determination of the redox potential maximum is done regularly because the maximum value varies somewhat with the acid composition. In practice a time interval of 4–24 hrs between each determination has shown to be adequate in steel pickling units.

The described procedure of determining the redox potential maximum value can be manual or controlled by a process computer. In the latter case the computer can also initiate a new determination with adequate time intervals.

Each time the redox potential maximum has been determined a redox potential set point is chosen. Although the redox potential value is partially the same in the zone of hydrogen peroxide excess as in the zone of dissolved $NO_x$ (see FIG. 1), it has been found that the system can be optionally set, such that either a small hydrogen peroxide deficienct (zone II in FIG. 1) or small hydrogen peroxide excess (zone III in FIG. 1) is automatically maintained at the measuring point B for the redox potential.

The set point can either be chosen in the region of a small hydrogen peroxide deficiency (zone II in FIG. 1) or in the region of a small hydrogen peroxide excess (zone III–IV in FIG. 1). In the deficiency region II, an adequate set point will be less than 40 mV, preferably 5–30 mV below the redox potential maximum. The redox potential difference between maximum and setpoint may be chosen with respect to the degree of required reduction of the $NO_x$ emission.

In the excess region (III–IV in FIG. 1) an adequate set point will be less than 200 mV, preferably 5–90 mV (corresponds to 0.005–0.9 g/l hydrogen peroxide) lower than the redox potential maximum.

It has further been found that regulation in zone II gives better economy than regulation in zone III, i.e. reduced consumption of hydrogen peroxide in relation to the purification effect obtained.

In the case of regulation in zone II, it has proved very easy to obtain steady-state conditions. Under steady-state conditions, the redox value varies a few mV above and below the set point. In the illustrated Example, a desired value which is 10–30 mV below the maximimum value on the redox potential curve has been found to give a steady regulation and a satisfactory degree of purification. In order to ensure that the zone of hydrogen peroxide excess is not entered, the regulator may be provided with a control function which interrupts the addition of hydrogen peroxide a few seconds if the redox potential starts fluctuating or varying by more than 10 mV per sec., which is characteristic of the redox process with hydrogen peroxide excess. Such a short interruption in the supply of hydrogen peroxide will immediately reset the redox potential at a value with hydrogen peroxide deficiency, and the control system again enters into operation. In actual practice, it has been found that such a control function is scarcely necessary.

If regulation in zone III (slight hydrogen peroxide excess) is desirable, it should first be ensured that the redox value is higher than the desired value. This may be effected by manual supply of hydrogen peroxide or regulation with hydrogen peroxide deficiency as described above. The system is therafter adjusted into zone III. Under steady-state conditions, the variations of the redox value at the measuring point B are in this case about 20 mV above and below the value of the regulator.

As measuring electrodes for measuring the redox potential, it is possible to use electrodes of a material that is inert to the acid bath (e.g. platinum, gold or rhodium). As reference electrodes, it is possible to use e.g. saturated calomel or silver chloride electrodes.

The surface treatment baths used usually have a volume of up to 50 $m^3$. In small surface treatment baths (up to a volume of about 5 $m^3$), it is possible to replace circulation with intense agitation in the pickling tank. In such case, the measurement of the redox potential is carried out in the pickling tank and the addition of hydrogen peroxide (controlled by the regulator) is carried out in the pickling tank. In large pickling tanks, of a volume exceeding about 5 $m^3$, it is difficult in practice to design the system for agitation instead of circulation.

The invention will be explained in more detail in the following Example.

EXAMPLE

Annealed stainless strip plate was pickled in a 13 $m^3$ pickling bath containing 20% of nitric acid and 4% of hydrofluoric acid, and dissolved metal (iron 30–40 g/l, chromium 5–10 g/l, nickel 2–4 g/l). The temperature in the bath was 60° C. The pickling bath was circulated at a flow rate of 20 $m^3$/h through a circulation conduit which was provided with a redox potential meter, redox regulator and supply means for 35% hydrogen peroxide (see FIG. 2).

By manually gradually increasing the flow of hydrogen peroxide from 0–55 l/h the redox potential maximum value was determined to be 855 mV for the actual pickling acid.

The following Table states the conditions and results for 7 different tests. Tests 1–3 relate to the pickling of a chrome-nickel steel (SIS 2333), steel grade A. Tests 4–5 relate to an unintentional stoppage of the operation. Tests 6–7 relate to the pickling of a chrome-nickel-molybdenum steel (SIS 2343), steel grade B, with a lower $NO_x$ formation per unit of time than in the pickling in Tests 1–3.

In all cases, the results are shown under steady state conditions, i.e. after the system is in equilibrium. The amount of $NO_x$ in kg is calculated under the assumption that the average molecular weight is 38 (50 mole% NO, 50 mol% $NO_2$).

Results and discussion:

Tests 1–2: By regulation with a slight hydrogen peroxide excess (Test 2), a high and even purification degree (87% compared with reference Test 1) was obtained.

Tests 2–3: By regulating with a slight hydrogen peroxide deficiency (Test 3), a considerably smaller amount of hydrogen peroxide (31% less) was consumed than in the regulation with hydrogen peroxide excess (Test 2), although the purification degree in Test 3 was but insignificantly lower (84% compared with 87%).

Tests 4–5: At a temporary, unintentional stoppage, i.e. with no feed of sheet-metal into the pickling bath, the supply of hydrogen peroxide gradually dropped to zero when the automatic control was connected (Test 4). If the supply was instead manually set (Test 5), i.e. with no automatic control, the addition of hydrogen peroxide continued on a constant level despite the absence of newly formed $NO_x$.

Tests 1 and 3; 6 and 7: When switching from one steel grade to another steel grade which, without any purification, produced a smaller amount of $NO_x$ than the preceding grade - 6.5 kg/h (Test 6) compared with 12.0 kg/h (Test 1) —the consumption of hydrogen peroxide dropped considerably —from 42 l/h (Test 3) to 18 l/h (Test 7) - upon regulation with a slight hydrogen peroxide deficiency at a substantially unaltered purification degree (82% in Test 7 compared with 84% in Test 3).

TABLE

| Test No | Redox potential | | | | | | |
|---|---|---|---|---|---|---|---|
| | Form of $H_2O_2$-dosage | Desired value mV | Actual value mV | Zone in FIG. 1 | Dosage of $H_2O_2$ l/h | $NO_x$-emission kg/h | $NO_x$-reduction % |
| Steel grade A | | | | | | | |
| 1. Reference Steel grade A | — | — | 770 | I | — | 12.0 | |
| 2. Regulation with slight hydrogen peroxide excess | Automatic | 730 | 710–750 | III | 61 | 1.55 | 87 |
| 3. Regulation with hydrogen peroxide deficiency | Automatic | 835 | 830–840 | II | 42 | 1.90 | 84 |
| 4. Temporary stoppage, no feed of sheet-metal | Automatic | 835 | 830–840 | II | 0 | 0 | — |
| 5. Temporary stoppage, no feed of sheet-metal | Manual | — | 650–700 | IV | 42 | 0 | — |
| Steel grade B | | | | | | | |
| 6. Reference Steel grade B | — | | 790 | I | — | 6.5 | |
| 7. Regulation with hydrogen peroxide deficiency | Automatic | 835 | 830–840 | II | 18 | 1.2 | 82 |

We claim:

1. A method of reducing the emission of $NO_x$ gas in a liquid containing nitric acid, characterized by measuring the redox potential in the liquid and adjusting the amount of hydrogen peroxide in relation to the redox potential, wherein the amount of hydrogen peroxide is adjusted so that the redox potential is at about its maximum value, wherein the redox potential is measured in the liquid, and hydrogen peroxide is automatically supplied to the liquid;

wherein the liquid, prior to the addition of hydrogen peroxide, contains sufficient nitric acid to result in the emission of $NO_x$ gas, and wherein the addition of hydrogen peroxide reduces the emission of said $NO_x$ gas; and wherein the liquid is used as a pickling bath for stainless steel or a liquid bath for surface treatment of copper or brass.

2. Method as claimed in claim 1, characterised by pumping the liquid through a circulation conduit externally of said bath, measuring the redox potential in said circulation conduit and automatically supplying hydrogen peroxide to the circulation conduit at a point upstream of the point of measurement of the redox potential.

3. Method as claimed in claim 2, characterised in that the total liquid volume of the bath is circulated in 0.1–2 h.

4. Method as claimed in claim 2, wherein the total liquid volume of the bath is circulated in 0.2–1 h.

5. A method of reducing the emission of $NO_x$ gas in a liquid containing nitric acid, characterized by measuring the redox potential in the liquid and adjusting the amount of hydrogen peroxide in relation to the redox potential, wherein the amount of hydrogen peroxide is supplied in an excess in relation to dissolved $NO_x$ in the liquid and to a redox potential value of less than 200 mV from the maximum value;

wherein the liquid, prior to the addition of hydrogen peroxide, contains sufficient nitric acid to result in the emission of $NO_x$ gas, and wherein the addition of hydrogen peroxide reduces the emission of said $NO_x$ gas; and wherein the liquid is used as a pickling bath for stainless steel or a liquid bath for surface treatment of copper or brass.

6. Method as claimed in claim 5, characterised in that the peroxide is supplied in an excess in relation to dissolved $NO_x$ in the liquid and to a redox potential value of less than 90 mV from the maximum value.

7. A method of reducing the emission of $NO_x$ gas in a liquid containing nitric acid, characterized by measuring the redox potential in the liquid and adjusting the amount of hydrogen peroxide in relation to the redox potential, wherein the amount of hydrogen peroxide is supplied in deficiency in relation to dissolved $NO_x$ in the liquid and to a redox potential value of less than 40 mV from the maximum value;

wherein the liquid, prior to the addition of hydrogen peroxide, contains sufficient nitric acid to result in the emission of $NO_x$ gas, and wherein the addition of hydrogen peroxide reduces the emission of said $NO_x$ gas; and wherein the liquid is used as a pickling bath for stainless steel or a liquid bath for surface treatment of copper or brass.

8. Method as claimed in claim 7, characterised in that the amount of hydrogen peroxide is supplied deficiency in relation to dissolved $NO_x$ in the liquid and to a redox potential value of less than 30 mV from the maximum value.

* * * * *